US006354686B1

(12) United States Patent
Tanaka et al.

(10) Patent No.: US 6,354,686 B1
(45) Date of Patent: Mar. 12, 2002

(54) INK JET RECORDING APPARATUS

(75) Inventors: Ryoichi Tanaka; Tomoaki Takahashi; Hirofumi Teramae, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/693,990

(22) Filed: Oct. 23, 2000

(30) Foreign Application Priority Data

Oct. 21, 1999 (JP) ..... 11-299856

(51) Int. Cl.[7] ..... B41J 29/38
(52) U.S. Cl. ..... 347/11; 347/9; 347/10
(58) Field of Search ..... 347/9–11, 68

(56) References Cited

FOREIGN PATENT DOCUMENTS

| | | | | |
|---|---|---|---|---|
| EP | 0636477 A2 * | 1/1995 | ..... | 347/10 |
| EP | 0 783 602 A2 | 10/1996 | ..... | B41J/2/045 |
| EP | 0827838 A2 * | 3/1998 | ..... | 347/11 |
| EP | 0 947 325 A1 | 10/1999 | ..... | B41J/2/045 |
| JP | 404250045 A * | 9/1992 | ..... | 347/11 |

* cited by examiner

*Primary Examiner*—John Barlow
*Assistant Examiner*—An H. Do
(74) *Attorney, Agent, or Firm*—Sughrue Mion, PLLC

(57) ABSTRACT

A drive signal COM1 or COM2 generated by a drive signal generator includes: a drive pulse DP1 or DP3 whose bias level is adjusted to a middle voltage Vm; a drive pulse DP2 whose bias level is adjusted to a ground voltage GND; a ready signal DP0, which includes a first correction element P0 for dropping the voltage from the middle voltage Vm to the ground voltage GND; and a recovery signal DP4, which includes a second correction element P14 for raising the voltage from the ground voltage GND to the middle voltage Vm. The ready signal DP0 precedes the drive pulse DP2, and the recovery signal DP4 follows the drive pulse DP2.

10 Claims, 11 Drawing Sheets

INK JET RECORDING APPARATUS

BACKGROUND OF THE INVENTION

The present invention relates to an ink jet recording apparatus that prints images by utilizing variable pressures, produced in a pressure generation chamber, to selectively eject ink droplets through nozzle orifices.

Various types of ink jet recording apparatuses, such as ink jet printers and ink jet plotters, include a recording head for ejecting ink droplets upon the receipt of a drive pulses. In such an apparatus, as the recording head is reciprocally moved in a main scanning direction, ink droplets are ejected and form images on a recording medium.

In order to both improve the image quality and to increase the recording speed, an ink jet recording apparatus employs a variable-dot recording method whereby a plurality of ink droplets, each of which differs in volume, is ejected from the identical nozzle orifices.

According to the variable-dot recording method, a drive signal is generated that corresponds to one of a plurality of drive pulses, each of which produces the ejection of a different volume of ink, that are arranged in a time series, thereby forcing the selection of an appropriate drive pulse that is thereafter supplied to a pressure generating element.

In this recording operation, the quantity of ink in a droplet that is to be ejected is determined in accordance with the image that is to be printed. For example, a large ink droplet (a large dot) is ejected when a portion of an image having a relatively dark tone is printed, whereas a small ink droplet (a micro dot) is ejected when a portion having a relatively light tone is printed and a middle sized ink droplet (a middle dot) is ejected when a portion having an intermediate tone is printed.

As a result, a reduction in the recording speed due to an excessive increase in the pixel density can be prevented, and tones for four values, large, middle, small and 0 (no ejection), can be provided for each pixel, making it possible to more quickly and more clearly record a high-quality image.

In addition, while the recording head is moved in the reverse direction, bidirectional recording, during which dots are formed between other dots that were recorded while the recording head was moved in the forward direction, is performed and the printing, in a short time period, of a high density image is thereby enabled.

When the variable dot recording process is to be performed, each drive pulse, selected in accordance with a drive signal, is optimized, in accordance with the volume of ink that is to be ejected, so that a bias level (a reference voltage), the shape of a waveform, and a drive voltage (the pitch) differ for each drive pulse.

Since the bias levels of the drive pulses must be matched in order for a drive signal to be generated, a method is proposed whereby, while a drive pulse having a high bias level is employed as a reference, a drive pulse having a low bias level is superimposed on the high bias level.

However, if only the drive pulse having the low bias level is superimposed on the drive pulse having the high bias level, the maximum potential of the drive signal will exceed the upper limit of a drive circuit.

SUMMARY OF THE INVENTION

It is, therefore, one objective of the present invention to provide an ink jet recording apparatus wherein a drive signal, consisting of a plurality of drive pulses whose bias levels differ, can be appropriately generated within a limited voltage level range.

In order to achieve the above object, there is provided an ink jet recording apparatus comprising:

- a recording head reciprocately moving in a main scanning direction with regard to a recording medium, the recording head provided with:
  - a nozzle orifice from which an ink drop is ejected;
  - a pressure chamber communicated with the nozzle orifice; and
  - a pressure generating element for generating pressure change in ink in the pressure chamber;
- a drive signal generator for generating a drive signal in which a plurality of drive pulses configured to drive the pressure generating element to eject an ink drop from the nozzle orifice, respectively, the drive signal including:
  - a first drive pulse configured to drive the pressure generating element to eject an ink drop from the nozzle orifice, and to have a reference bias level;
  - a second drive pulse configured to drive the pressure generating element to eject an ink drop from the nozzle orifice, and to have an individual bias level which is different from the reference bias level;
  - a ready waveform for varying a potential of the drive signal from the reference bias level to the individual bias level, which is arranged in the drive signal so as to precede to the second drive pulse; and
  - a recovery waveform for varying the potential of the drive signal from the individual bias level to the reference bias level, which is arranged in the drive signal so as to follow the second drive signal; and
- a drive pulse selector for selectively supplying at least one of the drive pulses and the waveforms in the drive signal to the pressure generating element to eject an ink drop from the nozzle orifice, wherein the drive pulse selector selects the second drive pulse together with the ready waveform and the recovery waveform.

[Means for Solving the Problems]

To achieve the above objective, according to a first aspect of the invention, an ink jet recording apparatus comprises:

- a recording head, which is reciprocally movable in a main scanning direction and which includes pressure generation chambers, which communicate with nozzle orifices, and pressure generating elements, for the application of alternate pressures in the pressure generation chambers;
- drive signal generator that, to eject ink droplets, generates a drive signal consisting of a plurality of drive pulses, arranged in a time series, and that is adjusted to a reference bias level; and
- drive pulse selector for selecting from the drive signal, which is generated by the signal generator, one of the drive pulses, which is supplied to the pressure generating elements to eject ink droplets through the nozzle orifices, wherein the drive signal generated by the drive signal generator consists of

- a first drive pulse at the reference bias level,
- a second drive pulse at an individual bias level differing from the reference bias level,
- a reference waveform for changing a voltage from the reference bias level to the individual bias level, and
- a recovery waveform for changing a voltage from the individual bias level to the reference bias level, wherein a ready waveform precedes the second drive pulse, and the recovery waveform follows the second drive pulse, and wherein the drive pulse selector selects both the ready waveform and the recovery waveform when choosing the second drive pulse.

The drive signal generated by the drive signal generator includes: a first drive pulse at the reference bias level that corresponds to the bias level of the drive signal; a second drive pulse at the individual bias level that differs from the reference bias level; a ready waveform that is used to change the voltage from the reference bias level to the individual bias level; and a recovery waveform that is used to change the voltage from the individual bias level to the reference bias level. The ready waveform precedes the second drive pulse, and the recovery waveform follows the second drive pulse. With the second drive pulse, the pulse selector selects both the ready waveform and the recovery waveform.

Therefore, since the ready waveform is supplied before the second drive pulse, the voltage has already been changed from the reference bias level to the individual bias level when the second drive pulse is supplied. Furthermore, the recovery waveform is supplied after the second drive pulse in order to return to the reference level the voltage that was changed to the individual bias level when the second drive pulse was supplied.

As a result, even when a plurality of drive pulses having different bias levels are included in a drive signal, the maximum voltage of the drive signal can be suppressed, and the drive signal can fall within the limited range described by the voltage level.

Preferably, the drive signal includes:

a forward drive signal in which the plural drive pulses are arranged in a predetermined order, which is generated during a forward scanning of the reciprocate movement performed with the recording head; and a reverse drive signal in which the plural drive pulses are arranged in an order resulted by inverting the predetermined order, which is generated during a reverse scanning of the reciprocate movement performed with the recording head.

Here, a period extending from a trailing end of the ready waveform to a leading end of the second drive pulse in the forward drive signal is coincided with a period extending from a trailing end of the ready waveform to a leading end of the second drive pulse in the reverse drive signal.

Preferably, the ready waveform is arranged in a head portion of the drive signal.

Preferably, a period extending from a leading end of the ready waveform to a trailing end thereof is equal or greater than a Helmholtz resonance cycle of the pressure chamber.

Preferably, a period extending from a leading end of the recovery waveform to a trailing end thereof is equal or greater than a Helmholtz resonance cycle of the pressure chamber.

Preferably, the ready waveform and the recovery waveform have a voltage gradient which is insufficient to eject an ink drop from the nozzle orifice, respectively.

Preferably, the individual bias level is set to a ground voltage.

Preferably, the second drive pulse serves as a reference drive pulse having an ejection waveform element for ejecting an ink drop which provides a positional reference in a pixel region. The ejection element is a waveform that serves as one part of a drive pulse, and according to which piezoelectric vibrators are activated for the ejection of ink droplets.

Here, a period extending from a leading end of the forward drive signal to a trailing end thereof and a period extending from a leading end of the reverse drive signal to a trailing end thereof are correspond to an unit print cycle. The unit print cycle is coincided with a sum of a period extending from the leading end of the forward drive signal to a leading end of the ejection waveform element in the forward drive signal and a period extending from the leading end of the reverse drive signal to a leading end of the ejection waveform element in the reverse drive signal.

Preferably, an interval between adjacent drive pulses in the forward drive signal is coincided with an interval between adjacent drive pulses in the reverse drive signal.

Preferably, the pulse selector selectively supplies the ready waveform and the recovery waveform to form a vibrating waveform for vibrating a meniscus of ink in the nozzle orifice at a magnitude at which an ink droplet will not be ejected in order to prevent a non-ejection state that causes the viscosity of ink to increase. This operation is performed during printing cycles.

DETAILED DESCRIPTION OF THE PREFERRED EMBODIMENTS

The preferred embodiment of the present invention will now be described by employing an ink jet printer (hereinafter referred to simply as a printer), a typical ink jet recording apparatus.

Figure 1:
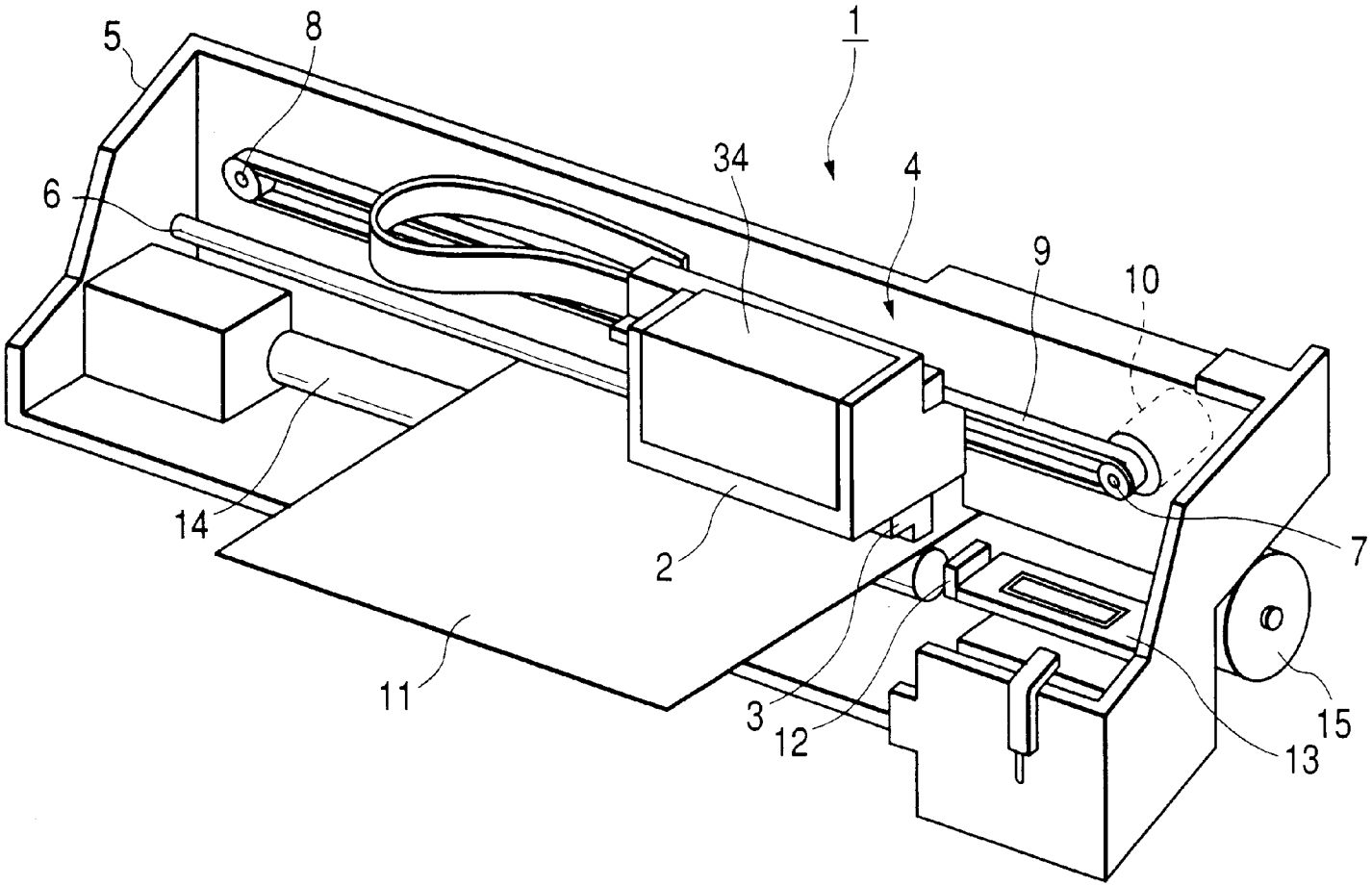
FIG. 1 is a perspective view for explaining the internal structure of a printer.

As is shown in FIG. 1, a printer I includes a carriage 4, on which a cartridge holder 2 and a recording head 3 are mounted. The carriage 4 is mounted on and can be moved along a guide member 6 that extends laterally in a housing 5. The carriage 4 is also connected to a timing belt 9 that is fitted around a drive pulley 7, which is bonded to the rotary shaft of a pulse motor 10, and an idler pulley 8. Therefore, as the pulse motor 10 rotates, the carriage 4 is displaced in the main scanning direction, widthwise, relative to a recording sheet 11.

A home position is set in an end area that lies outside the printing area but falls within the range within which the carriage 4 is moved. At the home position, a wiper unit 12, for cleaning the nozzle face of the recording head 3, and a capping unit 13, for capping the recording head 13, are positioned adjacent to each other.

Positioned below the carriage 4 is a platen (paper feeding roller) 14, the rotation of which is controlled by a paper feeding motor 15. that conveys the recording sheet 11 in the paper feeding direction (the sub-scanning direction).

To record characters or images on the recording sheet 11, ink droplets are ejected from the recording head 3 as the carriage 4 is moved in the main scanning direction and the recording sheet 11 is moved in the paper feeding direction.

The printer 1 performs bidirectional printing. That is, characters and images are recorded both during forward scanning, while the recording head 3 is being moved from its home position to the other, distant end, and during reverse scanning, while the recording head 3 is being returned to its home position.

Figure 2:
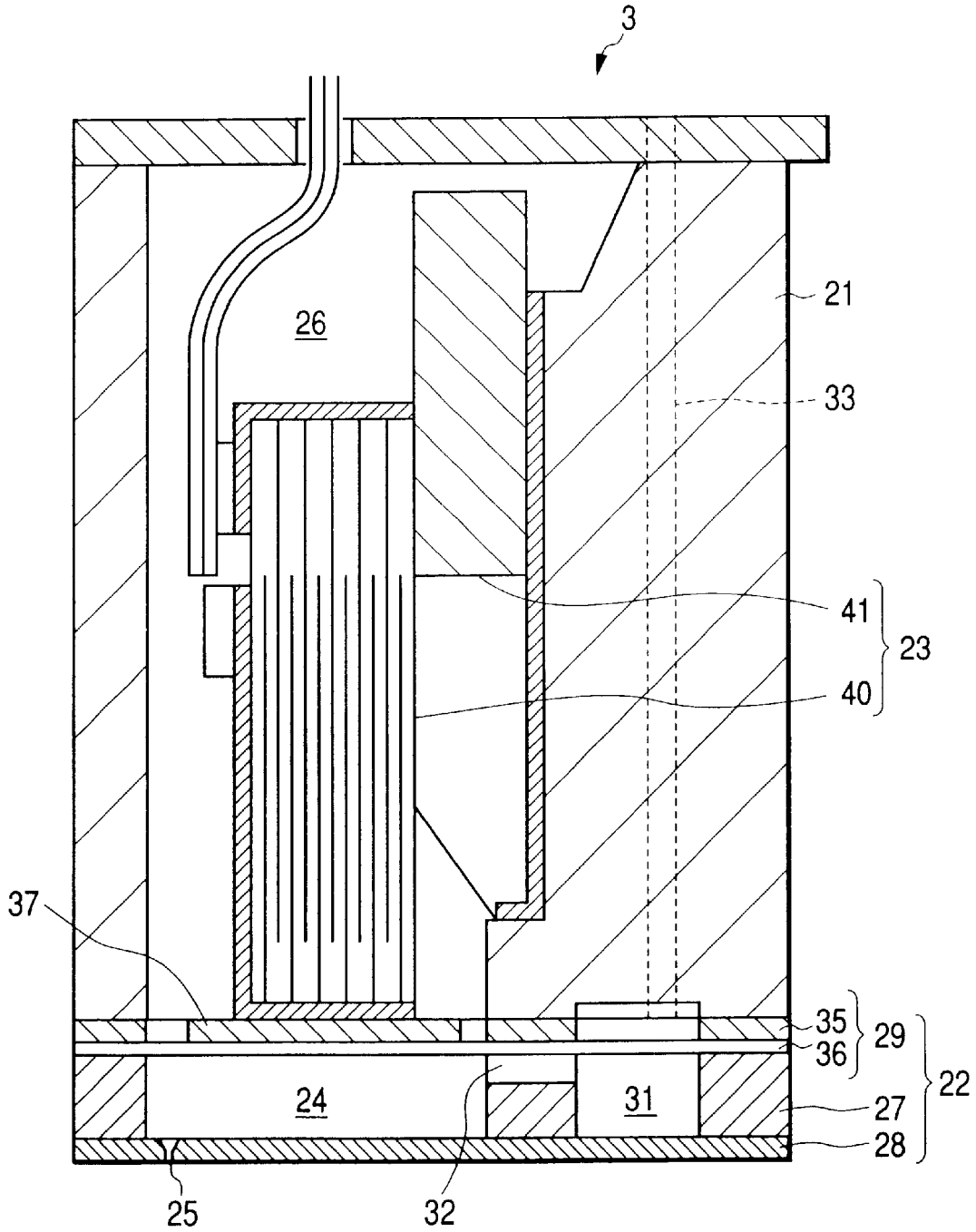
FIG. 2 is a cross-sectional view for explaining the structure of a recording head.

The structure of the recording head 3 will now be described. In the recording head 3 in FIG. 2, a flow path unit 22 is bonded to the distal end of a box-shaped case 21. A vibrator unit 23, which is internally stored within the case 21, generates fluctuating pressures in a pressure chamber 24, a part of the flow path unit 22, so as to eject ink droplets from a nozzle orifice 25.

The case 21 is a box, composed of a resin material, in which is formed a storage chamber 26 in which the vibration unit 23 is stored. The storage chamber 26 extends from the opening of the face to which the flow path unit 22 is bonded to the opposite face.

The flow path unit 22 is formed by bonding a nozzle plate 28 to one of the faces of a spacer 27 and by bonding a vibration plate 29 to the other face of the spacer 27.

The spacer 27 comprises a silicon wafer, and in it a predetermined pattern is formed by etching, i.e., partitions are appropriately formed to define a plurality of pressure chambers 24 that communicate with individual nozzle orifices 25, a common ink chamber 31 and a plurality of ink supply paths 32 that connect the common ink chamber 31 to the individual pressure chambers 24.

A connection port that is connected to an ink supply pipe 33 is provided for the common ink chamber 31, and ink contained in an ink cartridge 34 (see FIG. 1) is supplied, via the connection port, to the common ink chamber 31.

The nozzle orifices 25 are formed as an array in the nozzle plate 28 at a pitch that corresponds to the dot formation density.

The vibration plate 29 has a double structure wherein an elastic film 36, such as a PPS film, is laminated on a stainless plate 35. The portions of the stainless plate that correspond to the pressure chambers 24 are etched in a ring shape, and an island portion 37 is formed in the ring.

The vibration unit 23 is constituted by piezoelectric vibrators (one type of pressure generating element) 40 and a fixed member 41. The piezoelectric vibrators 40 are shaped like the teeth of a comb by forming slits, at predetermined pitches that correspond to the pressure chambers 24 of the flow path unit 22, in a single piezoelectric vibration plate wherein piezoelectric members and electrode layers are alternately laminated, and the fixed member 41 is secured to the base end of the comb-tooth shaped vibrators 40.

The vibration unit 23 is inserted into the storage chamber 26 of the case, so that from the opening, the distal ends of the piezoelectric vibrators 40 are exposed, and is stored by bonding the fixed member 41 to the inner wall of the storage chamber 26. In this state, the individual distal ends of the piezoelectric vibrators 40 contact, and are connected to, the island portion 37 of the vibration plate 29.

When a voltage difference is applied between opposite electrodes, the individual piezoelectric vibrators 40 are extended or contracted in the longitudinal direction of the device, perpendicular to the direction of lamination, and displace the elastic film 36 that defines the pressure chambers 24. That is, for this recording head, since the piezoelectric vibrators 40 are extended in the longitudinal direction of the device, the island portion 37 is driven toward the nozzle plate 28, the elastic film 36 around the island portion 37 is bent and the pressure chambers 24 are contracted. When the piezoelectric vibrators 40 are retracted in the longitudinal direction of the device, the elastic film 36 is displaced and the pressure chambers 24 are expanded accordingly. As the pressure chambers 24 are expanded or contracted, the pressure imposed on the ink that fills the pressure chambers 24 fluctuates, and ink droplets are ejected from the nozzle orifices 25 of the flow path unit 22.

Figure 3:
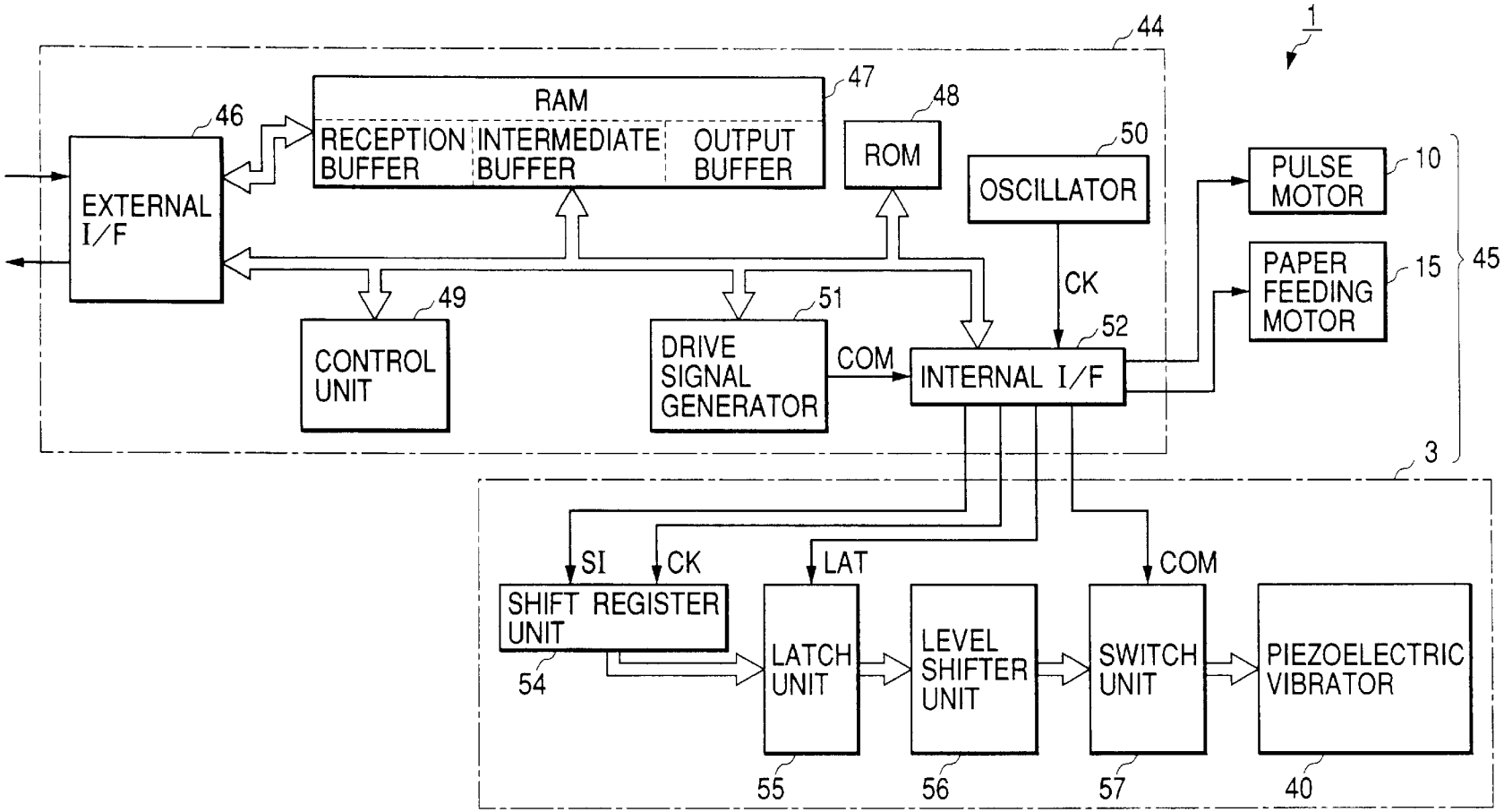
FIG. 3 is a block diagram for explaining the electrical structure of the printer.

The electrical driving system of the printer 1 will now be described. As is shown in FIG. 3, the electrical driving system of the printer 1 is roughly constituted by a printer controller 44 and a print engine 45.

The printer controller 44 comprises an external interface 46 (hereinafter referred to as the external I/F 46); a RAM 47, for temporarily storing various data; a ROM 48, for storing a control program; a control unit 49, which includes a CPU, an oscillator 50 for generating a clock signal and a drive signal generator 51 for generating a drive signal (COM) to be transmitted to the recording head 3; and an internal interface 52 (hereinafter referred to as the internal I/F 52) for transmitting, to the print engine 45, dot pattern data (bit map data) that are developed based on a drive signal and print data.

The external I/F 46 receives, from a host computer (not shown), print data that are formed using character code, a graphic function and image data. A busy signal (BUSY) or an acknowledgement signal (ACK) is output to the host computer via the external I/F 46.

The RAM 47 serves as a reception buffer, an intermediate buffer, an output buffer and a work memory (not shown). The print data received via the external I/F 46 are temporarily stored in the reception buffer, intermediate code data obtained through conversion by the control unit 49 is stored in the intermediate buffer, and the dot pattern data is stored in the output buffer. The dot pattern data are print data for a plurality of bits that are obtained by decoding (translating) gray scale data.

A control program (a control routine) for various data processes, font data and graphic serves are stored in the ROM 48.

In addition to exercising various controls, the control unit 49 reads print data from the reception buffer, and converts the print data to obtain intermediate code data, which it stores in the intermediate buffer. Furthermore, the control unit 49 analyzes the intermediate code data read from the intermediate buffer, and by referring to the font data and the graphic serves stored in the ROM 48, develops the intermediate code data and obtains dot pattern data. Furthermore, for the dot pattern data, the control unit 49 performs a required styling process and outputs the resultant print data to the output buffer.

When dot pattern data is obtained for one line that can be recorded by one main scan performed by the recording head 3, the control unit 49 outputs to the recording head 3, via the internal I/F 52, the dot pattern data (the print data) for the one line. And when the dot pattern data for the one line is output by the output buffer, intermediate code data, which is obtained by a development process, is eliminated from the intermediate buffer, and a development process for the next intermediate code data is begun.

The drive signal generator 51 generates a drive signal (COM) consisting of a time series, composed of a plurality of drive pulses, for enabling the ejection of ink droplets, and that is adjusted in accordance with the reference bias level.

Figure 7A:
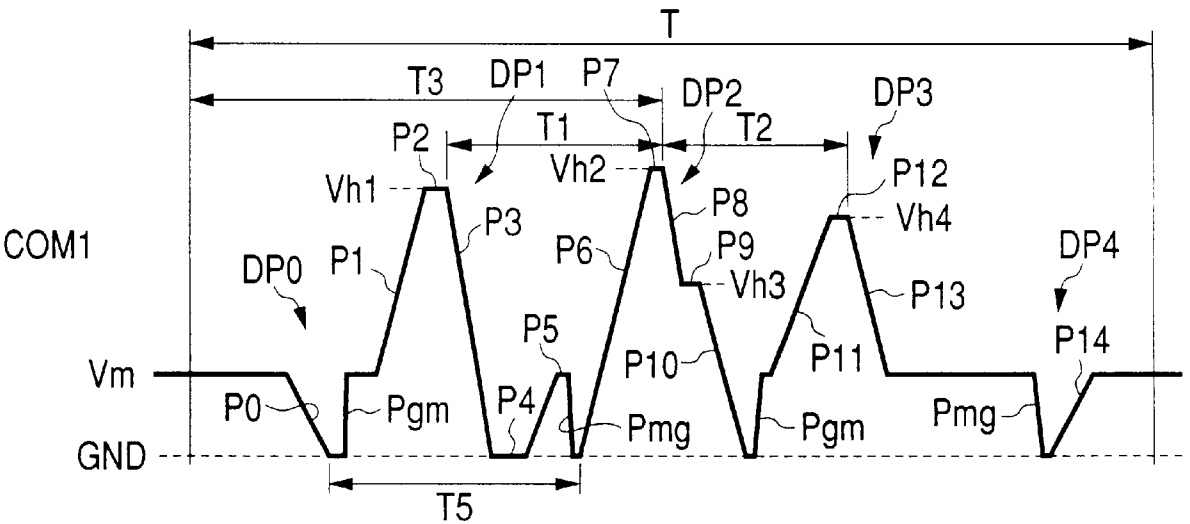
FIGS. 7A and 7B are diagrams for respectively explaining a drive signal for forward scanning and a drive signal for reverse scanning in accordance with the present invention.

During the forward scanning performed with the recording head 3, the drive signal generator 51 generates a forward drive signal COM1, wherein a plurality of drive pulses in a time series are arranged in a predetermined order. In this embodiment, as is shown in FIG. 7A, a signal is generated that consists of a series composed of a ready signal DP0, a large dot drive pulse DP1, a microdot drive pulse DP2, a middle dot drive pulse DP3 and a recovery signal DP4.

Figure 7B:
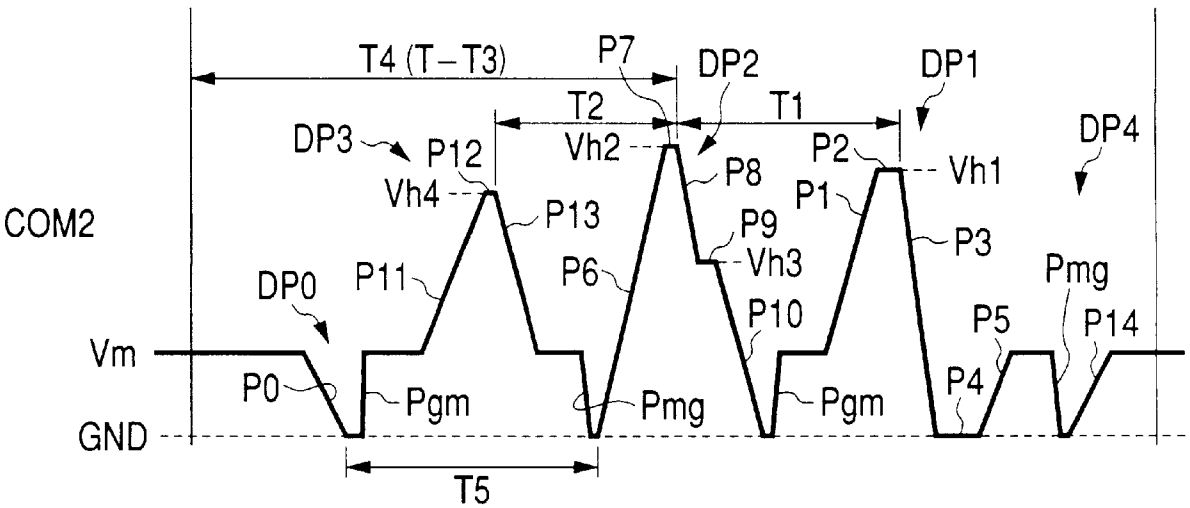

During the reverse scanning performed with the recording head 3, the drive signal generator 51 generates a reverse drive signal COM2, wherein the order in which drive pulses are arranged is the reverse of the order provided for the forward drive signal COM1. In this embodiment, as is shown in FIG. 7B, a signal is generated consisting of a series composed of a ready signal DP0, a middle dot drive pulse DP3, a microdot drive pulse DP2, a large dot drive pulse DP1 and a recovery signal DP4.

The arrangement of the drive signal generator 51 and the drive signals COM1 and COM2, generated by the drive signal generator 51, will be described in detail later.

The print engine 45 includes the paper feeding motor 15, the pulse motor 10 and the recording head 3.

The paper feeding motor 15, which is the driving source that rotates the platen 14 for feeding paper, moves the recording sheet 11 in the sub-scanning direction, while interacting with the recording process for which the recording head 3 is used.

The pulse motor 10 is a driving source for moving the carriage 4, on which the recording head 3 is mounted, in the main scanning direction.

Figure 4:
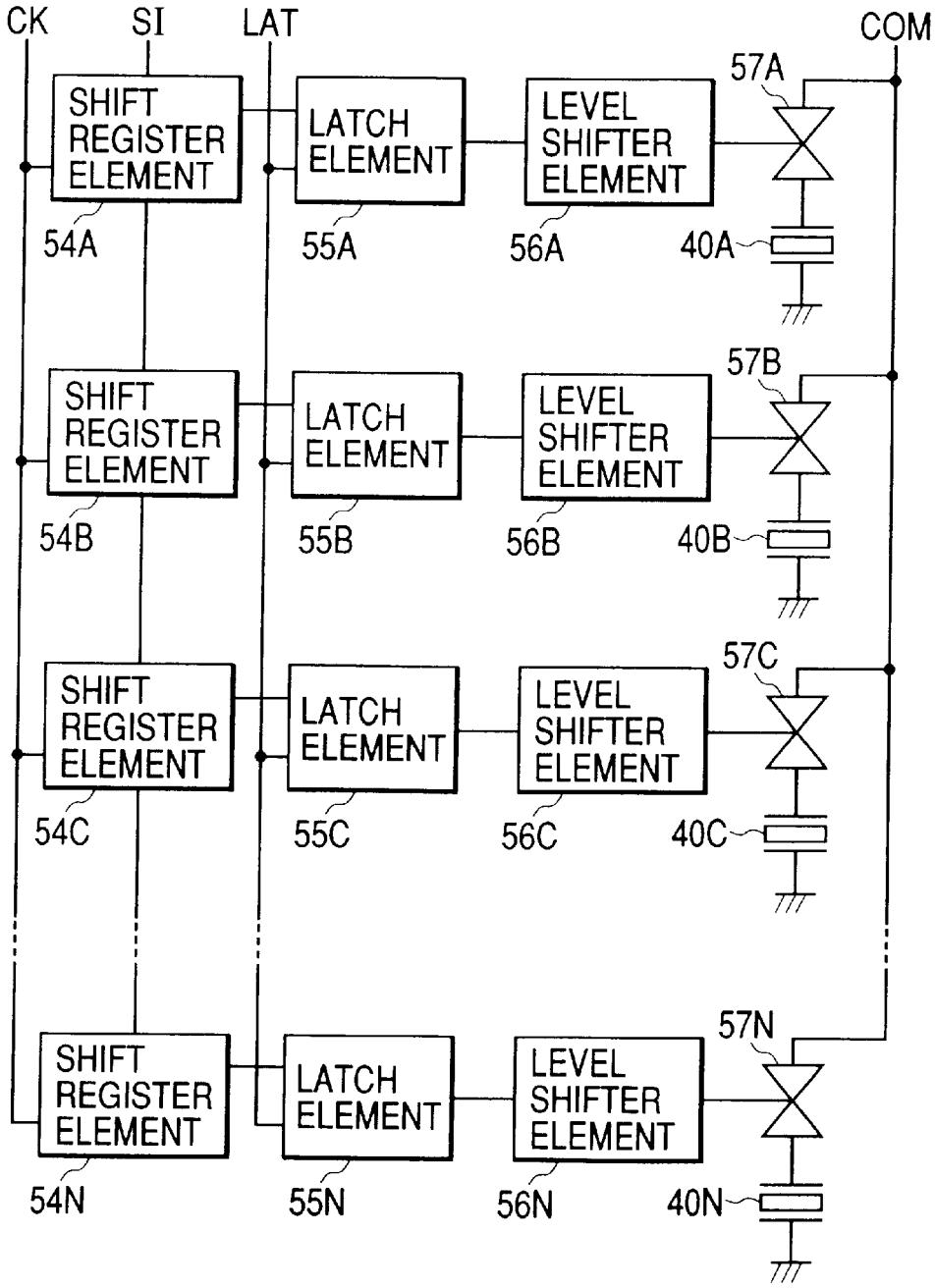
FIG. 4 is a diagram for explaining the electrical structure of the recording head.

The recording head 3 includes a shift register unit 54, a latch unit 55, a level shifter unit 56, a switch unit 57 and the piezoelectric vibrators 40. Actually, as is shown in FIG. 4, shift register elements 54A to 54N, latch elements 55A to 55N, level shifter elements 56A to 56N, switch elements 57A to 57N, and piezoelectric vibrators 40A to 40N are respectively provided for the nozzle orifices 25.

The recording head 3 appropriately ejects ink droplets, containing varying quantities of ink, based on print data (SI) received from the printer controller 44.

Specifically, during the recording process, synchronized by a clock signal (CK) output by the oscillator 50, the control unit 49 serially transmits data, selected from the output buffer, for the most significant bit array for one dot of the print data (SI), and sequentially sets the data in the shift register elements 54A to 54N.

When the print data for all the nozzle orifices 25 have been set in the shift register elements 54A to 54N, in accordance with a predetermined timing the control unit 49 outputs a latch signal (LAT) to the latch elements 55A to 55N. Then, upon the receipt of the latch signal, the latch elements 55A to 55N latch the print data that are set in the shift register elements 54A to 54N. Thereafter, the latched print data are supplied to the level shifter elements 56A to 56N, which are voltage amplifiers.

The level shifter elements 56A to 56N boost a print data level of, for example, "1" to a voltage level whereat the switch 57 can be driven, e.g., by several tens of voltage, and then, the boosted print data are transmitted to the switch elements 57A to 57N, which are connected in turn. Here it should be noted that the level shifter elements 56A to 56N do not boost a print data level of, for example, "0." The drive signal COM is transmitted by the drive signal generator 51 to the switch elements 57A to 57N, and when these switch elements 57A to 57N are connected, the drive signal is transmitted to the piezoelectric vibrators 40A to 40N, which are connected to the switch elements 57A to 57N.

After the control unit 49 has transmitted the drive signal based on the data for the most significant bit array, the control unit 49 serially transmits data, lower by one bit row, and sets the data in the shift register elements 54A to 54N. Then, a latch signal is transmitted to latch these data, and the drive signal is supplied to the piezoelectric vibrators 40A to 40N.

Thereafter, the same process is repeatedly performed until the least significant bit array of the print data is obtained by shifting to print data occupying a one bit lower row. Then, when the process has been completed for the least significant bit of the print data, the process is again performed for the print data for the next dot.

As is described above, whether or not the recording head 3 should transmit the drive signal to the piezoelectric vibrators 40 can be determined by using the print data received from the control unit 49. That is, when the print data is set to a value of "1" the drive signal is transmitted to the piezoelectric vibrators 40, and when the print data is set to a value of "0," the transmission of the drive signal to the piezoelectric vibrators 40 is halted.

Therefore, relative to the forward drive signal COM1 in FIG. 7A and the reverse drive signal COM2 in FIG. 7B, the individual bits of print data are set in consonance with the drive pulses DP1 to DP3, the ready signal DP0 and the recovery signal DP4, which are arranged in a time series, so that these signals can be selectively transmitted to the piezoelectric vibrators 40.

In addition, since the drive pulse to be transmitted to the piezoelectric vibrators 40 is selected, ink droplets composed of different quantities of ink can be ejected through the same nozzle orifice 25.

To eject the ink droplets, in accordance with the control unit 49, the shift register unit 54, the latch Unit 55, the level shifter unit 56, and the switch unit 57 function as a drive pulse selector of the present invention.

Figure 5:
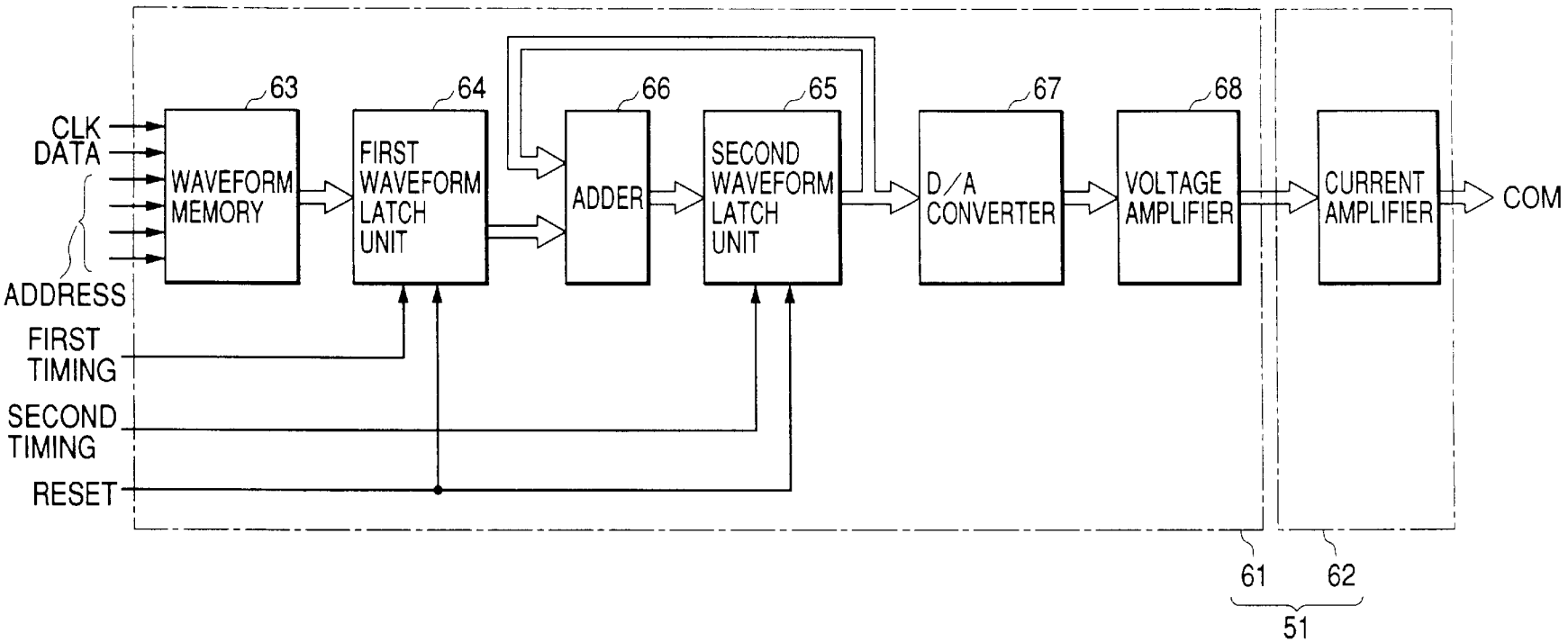
FIG. 5 is a block diagram for explaining the electrical structure of a drive signal generator.

The drive signal generator 51 in this embodiment will now be described. As is shown in the block diagram in FIG. 5, the drive signal generator 51 roughly comprises a waveform generator 61 and a current amplifier 62.

The waveform generator 61 includes a waveform memory 63, a first waveform latch unit 64, a second waveform latch unit 65, an adder 66, a digital-analog converter (D/A converter) 67 and a voltage amplifier 68.

The waveform memory 63 individually stores data for a plurality of voltage changes, which are output by the control unit 49, and the first waveform latch unit 64 is electrically connected to the waveform memory 63.

Synchronized with the first timing signal, the first waveform latch unit 64 holds the data for the voltage change that are stored at a predetermined address in the waveform memory 63.

The adder 66 receives the output of the first waveform latch unit 64 and of the second waveform latch unit 65.

While the second latch unit 65, which is connected to the output terminal of the adder 66, and the adder 66 together function as voltage change data addition means and add together the output signals to produce a resultant signal.

The second waveform latch unit 65 holds data (voltage information) that are output by the adder 66 in synchronization with the second timing signal. The D/A converter 67, which is electrically connected to the output terminal of the second waveform latch unit 65, converts the output signal held in the second waveform latch unit 65 into an analog signal, and the voltage amplifier 68, which is electrically connected to the output terminal of the D/A converter 67, amplifies the analog signal produced by the D/A converter 67 to the voltage level of the drive signal.

The current amplifier 62, which electrically connected to the output terminal of the voltage amplifier 68, amplifies the current of the signal whose voltage has been amplified by the voltage amplifier 68, and outputs the drive signal COM (COM1 or COM2).

Before the generation of a drive signal, the thus arranged drive signal generator 51 stores a plurality of data sets, indicating a voltage change, in individual storage areas in the waveform memory 63. For example, the control unit 49 outputs voltage change data and corresponding address data to the waveform memory 63, and stores the change data in the storage area, in the waveform memory 63, that is designated by the address data. In this embodiment, the voltage change data consist of data that include positive and negative information (increment/decrement information), and the address data consist of a four-bit address signal.

After a plurality of voltage change data sets have been stored in the waveform memory 63, the generation of the drive signal is enabled.

During the process for the generation of a drive signal, the voltage change data are set in the first waveform latch unit 64, and for each predetermined update period, the voltage change data in the first waveform latch unit 64 are added to the output voltage of the second waveform latch unit 65.

In this embodiment, the four-bit address signal input to the waveform memory 63 and the first timing signal input to the first waveform latch unit 64 are employed to set the voltage change data in the first waveform latch unit 64. That is, based on the address signal, target voltage change data in the waveform memory 63 are selected, and upon the receipt of the first timing signal, the first waveform latch unit 64 reads the selected voltage change data from the waveform memory 63 and holds it.

The voltage change data held by the first waveform latch unit 64 is then transmitted to the adder 66, and as the output voltage of the second waveform latch unit 65 is also transmitted to the adder 66, the data output by the adder 66 is a voltage value obtained by adding the voltage change data held by the first waveform latch unit 64 and the output voltage held by the second waveform latch unit 65. Since the voltage change data includes positive and negative information, when the voltage change data is a positive value the data output by the adder 66 has a higher voltage value than does the output voltage. When the voltage change data is a negative value, however, the data output by the adder 66 has a lower voltage value than does the output voltage. Whereas when the voltage change data has a value of "0," the data output by the adder 66 has the same voltage value as does the output voltage.

In synchronization with the second timing signal, the data output by the adder 66 are fetched and held by the second waveform latch unit 64. In other words, the output voltage of the second waveform latch unit 65 is updated in synchronization with the second timing signal.

Figure 6:
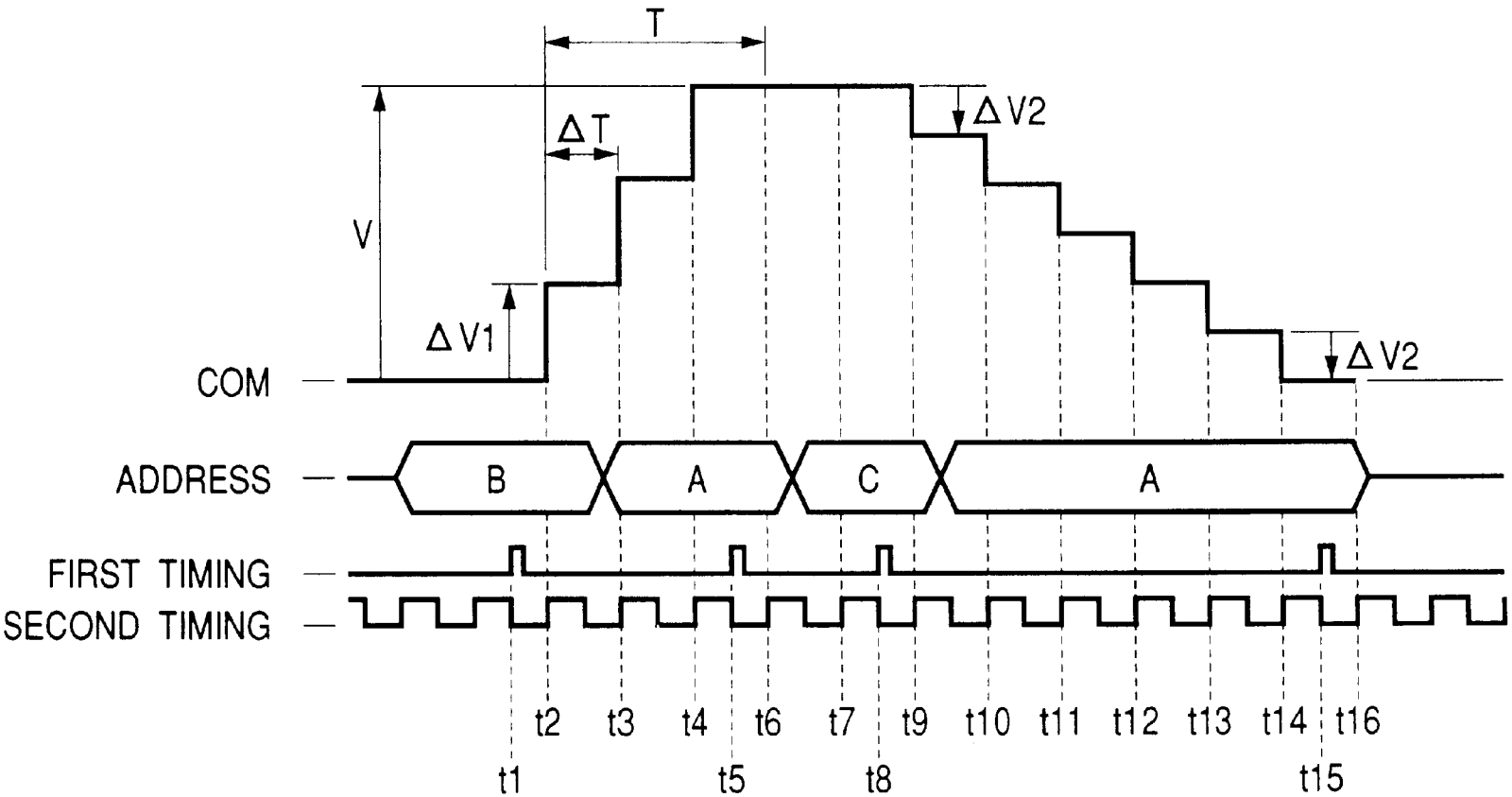
FIG. 6 is a timing chart for explaining the processing performed by the drive signal generator when generating a drive signal.

The operation for the generation of the drive signal will now be described by using a specific example in FIG. 6. In this example, as voltage change data a "0" is stored at address A in the waveform memory 63, +ΔV1 is stored at address B, and −ΔV2 is stored at address C.

When the first timing signal is input while an address signal designating address B is input to the waveform memory 63 (t1), the first waveform latch unit 64 reads the voltage change data +ΔV1 from address B in the waveform memory 63, and holds it. Then, at the update timing consonant with the second timing signal, e.g., at the leading edge of the second timing signal, the second waveform latch unit 65 fetches and holds the output data of the adder 66 (t2). In this example, in consonance with the first update timing event following the supply of the first timing signal, as a new output voltage the second waveform latch unit 65 holds ΔV1, which is obtained by adding ΔV1 to the ground voltage GND, the current output voltage.

When, following the elapse of a cycle ΔT, the next update timing event occurs, as new output voltage data the second waveform latch unit 65 holds 2ΔV1 (ΔV1+ΔV1), which is obtained by adding ΔV1 to the current output voltage ΔV1 (t3).

Following the elapse of another cycle ΔT and in consonance with the next update timing event, as new output voltage data the second waveform latch unit 65 holds V (2ΔV1+ΔV1).

When the voltage change data stored at address B, which is designated by the received address signal, is held by the first waveform latch unit 64, the address designated by the address signal is changed to address A.

The address signal designating address A is referred to upon the receipt of the next first timing signal (t5). That is, upon the receipt of the first timing signal, the first waveform latch unit 64 reads the voltage change data "0" from address A in the waveform memory 63, and holds it.

When "0," the voltage change data, is held by the first waveform latch unit 64, the output data of the adder 66 has the same voltage value as the output voltage of the second waveform latch unit 65. Thus, during a period wherein the voltage change data "0" is held by the first waveform latch unit 64, the output voltage of the second waveform latch unit 65 is maintained at V, which is the previous voltage value, even when an update timing event in consonance with the second timing signal occurs (t6 and t7).

When the next first timing signal is input, the voltage change data −ΔV2, which is the data stored at address C, is held by the first waveform latch unit 64 (t8).

When −ΔV2, the voltage change data, is held, the voltage output by the second waveform latch unit 65 is reduced ΔV2 each time an update timing event regulated by the second timing signal occurs (t9 to t14).

Further, when the next first timing signal is input, "0," the voltage change data for address A, is held by the first waveform latch unit 64 (t15). Therefore, for the next update timing event the output voltage of the second waveform latch unit 65 is maintained at the previous voltage level (t16).

As is described above, the control unit 49 need only output the address signal and the timing signal to the drive signal generator 51, so that an arbitrary shape can be set as the waveform for the drive signal COM.

When the voltage value of the drive signal COM is increased, a charge is placed on the piezoelectric vibrators 40 of the recording head 3 and they are retracted in the longitudinal direction, thereby increasing the volume of each pressure chamber 24. Then, when the voltage value of the drive signal COM is reduced, the charge is removed from the piezoelectric vibrators 40 and they are extended in the longitudinal direction, thereby reducing the volume of each pressure chamber 24.

The drive signal COM generated by the drive signal generator 51 will now be described in detail.

During the forward scanning performed by the recording head 3, as is shown in FIG. 7A, the drive signal generator 51 generates the forward drive signal COM1 in which the ready signal DP0, the large dot drive pulse DP1, the microdot drive pulse DP2, the middle dot drive pulse DP3, and the recovery signal DP4 are arranged in the named order.

During the reverse scanning performed by the recording head 3, as is shown in FIG. 7B, the drive signal generator 51 generates the reverse drive signal COM2 in which the ready signal DP0, the middle dot drive pulse DP3, the microdot drive pulse DP2, the large dot drive pulse DP0, and the recovery signal DP4 are arranged in the named order.

A print cycle T is set, for example, at 92.6 μs (microseconds) for both the forward drive signal COM1 and the reverse drive signal COM2. The print cycle T is the time period allocated for the recording of one pixel.

The bias levels of the forward drive signal COM1 and the reverse drive signal COM2 are adjusted to the middle voltage Vm, which, in accordance with the invention, corresponds to the reference bias level.

The drive pulses DP1, DP2 and DP3, which are included in and are the same for the drive signals COM1 and COM2, are pulses for enabling the ejection of ink droplets having different volumes.

The microdot drive pulse DP2 is formed as a waveform for the ejection, through the nozzle orifice 25, a small ink droplet, e.g., an ink droplet of about 3 pL (picolitter), that forms a microdot.

The bias level of the microdot drive pulse DP2 is adjusted in consonance with the ground voltage GND, and differs from the middle voltage Vm, which is the bias level for the drive signal COM. That is, in accordance with the invention, the microdot drive pulse DP2 corresponds to the second drive pulse and its bias level corresponds to the individual bias level.

The microdot drive pulse DP2 includes: a second expansion element P6, for increasing the voltage, at a constant inclination that will not eject ink droplets, from the ground voltage GND to a second maximum voltage Vh2; a second expansion holding element P7, for holding the second maximum voltage Vh2 for an extremely short time period; a second ejection element P8, for dropping (discharging) the voltage, at a sharp inclination, from the second maximum voltage Vh2 to a discharge voltage Vh3; a discharge holding element P9, for holding the discharge voltage Vh3 for an extremely short time period; and a discharge element P10, for dropping the voltage from the discharge voltage Vh3 to the ground voltage GND.

The microdot that is formed by supplying the microdot drive pulse DP2 is used as a position reference for a pixel area (an area in which a dot constituting one pixel can land). Therefore, the microdot drive pulse DP2 serves as a reference drive pulse.

The drive signal generator 51 generates the microdot drive pulse DP2 substantially in consonance with the intermediate timing in the forward drive signal COM1 or the reverse drive signal COM2. In other words, the microdot drive pulse DP2 is located in the center of the drive signal COM. Therefore, the microdot can be formed substantially in the center of the pixel area in the main scanning direction.

An interval T3, which extends from the start of the print cycle T in the forward drive signal COM1 to the starting edge of the second ejection element P8 in the microdot drive pulse DP2, is set at 45.5 μs; an interval T4, which extends from the start of the print cycle T in the reverse drive signal COM2 to the starting edge of the second ejection element P8 in the microdot drive pulse DP2, is set at 47.1 μs; and the sum of the interval T3 in the forward drive signal COM1 and the interval T4 in the reverse drive signal COM2 is set equal to one print cycle T (92.6 μs).

The middle dot drive pulse DP3 is formed as a waveform to enable the ejection, through the nozzle orifice 25, of a middle ink droplet, e.g., an ink droplet of about 10 pL, that can form a middle dot.

The bias level of the middle dot drive pulse DP3 is adjusted in consonance with the middle voltage Vm, which is the bias level (reference bias level) of the drive signal COM. That is, in accordance with this invention, the middle dot drive pulse DP3 corresponds to the first drive pulse.

The middle dot drive pulse DP3 includes: a third expansion element P11, for increasing the voltage, at a constant inclination that will not cause ink droplets to be ejected, from a middle voltage Vm to a third maximum voltage Vh4; a third expansion holding element P12, for holding the third maximum voltage Vh4 for a predetermined short time period; and a third ejection element P13, for dropping (discharging) the voltage, at a sharp inclination, from the third maximum voltage Vh4 to the middle voltage Vm.

The timing for the generation of the middle dot drive pulse DP3 (the location in the drive signal COM) is determined by using the microdot drive pulse DP2 as a reference.

That is, the interval from the middle dot drive pulse DP3 to the microdot drive pulse DP2 in the forward drive signal COM1 is set equal to the interval from the middle dot drive pulse DP3 to the microdot drive pulse DP2 in the reverse drive signal COM2.

Specifically, the interval from the second ejection element P8, which is a constituent of the microdot drive pulse DP2, to the third ejection element P13, which is a constituent of the middle dot drive pulse DP3, or even more specifically, the period extending from the discharge start timing for the second ejection element P8 to the discharge start timing for the third ejection element P13 is set to an interval T2, both for the forward drive signal COM1 and the reverse drive signal COM2.

The large dot drive pulse DP1 is prepared as a waveform for the ejection through the nozzle orifice 25 of a large ink droplet, e.g., an ink droplet of about 20 pL, that can form a large dot.

The bias level of the large dot drive pulse DP1 is also adjusted to the middle voltage Vm, which is the bias level for the drive signal COM. In other words, the large dot drive pulse DP1 also corresponds to the first drive pulse of the invention.

The large dot drive pulse DP1 includes: a first expansion element P1, for increasing the voltage, at a constant inclination that will not cause ink droplets to be ejected, from the middle voltage Vm to a first maximum voltage Vh1; a first expansion holding element P2, for holding the first maximum voltage Vh1 for a predetermined time period; a first ejection element P3, for dropping (discharging) the voltage, at a sharp inclination, from the first maximum voltage VH1 to the ground voltage GND; a retraction holding element P4, for holding the ground voltage GND for a predetermined time period; and a vibration control element P5, for increasing the voltage from the ground voltage GND to the middle voltage Vm.

The timing for the generation of the large dot drive pulse DP1 is also determined by using the microdot drive pulse DP2 as a reference.

The length of the interval from the large dot drive pulse DP1 to the microdot drive pulse DP2 in the forward drive signal COM1 is set equal to the length of the interval from the large dot drive pulse DP1 to the microdot drive pulse DP2 in the reverse drive signal COM2.

Specifically, the interval from the second ejection element P8 of the microdot drive pulse DP2 to the first ejection element P3 of the large dot drive pulse DP1, or even more specifically, the time period extending from the discharge start timing for the second ejection element P8 to the discharge start timing for the first ejection element P3 is set to an interval T1, both for the forward drive signal COM1 and the reverse drive signal COM2.

A The ready signal DP0 is selected when the microdot drive pulse DP2 is to be transmitted to the piezoelectric vibrator 40, or when a meniscus (a free ink surface that is exposed at the nozzle orifice 25) is to be vibrated slightly. The ready signal DP0 includes a first correction element P0, for dropping the voltage, at a constant, moderate inclination that will not cause ink droplets to be ejected, from the middle voltage Vm, which is the bias level for the drive signal COM, to the ground voltage GND, which is the bias level for the microdot drive pulse DP2.

The first correction element P0 is a waveform element that corresponds to the ready waveform of this invention, and its time width (pulse width) is set equal to or greater than the Helmholtz resonance cycle of the pressure chambers 24 of the recording head 3. In this embodiment, since the natural cycle Tc of the pressure chamber 24 is about 6.5 μs, the time width of the first correction element P0 is set at 6.5 μs, which is equal to the Helmholtz resonance cycle.

Since the time width (supply time) of the first correction element P0 is set equal to or greater than the Helmholtz resonance cycle of the pressure chamber 24, the residual vibration in the pressure chamber 24, which accompanies the application of the first correction element P0, can be prevented, and the volume of the pressure chamber 24 can be appropriately changed.

The ready signal P0 is located at the heads of both the drive signals COM1 and COM2. That is, the first correction element P0, which serves as the ready waveform, precedes the microdot drive pulse DP2 (the second drive pulse).

The interval from the end edge of the first correction element P0 of the ready signal DP0 to the starting edge of the second expansion element P6 of the microdot drive pulse DP2 is set to the interval T5, both for the forward drive signal COM1 and the reverse drive signal COM2. The length of the interval T5 is adequate for the satisfactory convergence of the vibration, due to the supply of the first correction element P0, of a meniscus. In this example, the interval T5 is set at 29 μs.

The ready signal DP0 need not be located at the head of the drive signal, so long as it precedes (is generated before) the microdot drive pulse DP2. When the ready signal DP0 is located at the head of the drive signal, as in this embodiment, the interval (period) between the first correction element P0 and the second expansion element P6 can be satisfactorily extended, so that the vibration of the meniscus, which accompanies the supply of the ready signal DP0, can be appropriately converged. Therefore, the quantity of ink in a small droplet can be stabilized.

The recovery signal DP4, as well as the ready signal DP0, is selected when the microdot drive pulse DP2 is to be supplied to the piezoelectric vibrator 40, or when the meniscus is to be vibrated slightly. The recovery signal DP4 includes a second correction element P14, for raising the voltage, at a constant, moderate inclination that will not cause ink droplets to be ejected, from the ground voltage GND to the middle voltage Vm.

The second correction element P14 is a waveform element that, in accordance with the invention, corresponds to the recovery waveform. The time width (pulse width) is set equal to or greater than the Helmholtz resonance cycle in the pressure chamber 24 of the recording head 3. In this embodiment, the time width of the second correction element P14 is set at 6.5 μs, which is equal to the Helmholtz resonance cycle, in order to prevent the residual vibration in the pressure chamber 24 that accompanies the application of the second correction element P14.

The recovery signal DP4 is located at the ends of both the drive signals COM1 and COM2. That is, the second correction element P14, which is a recovery waveform, follows the microdot drive pulse DP2 (the second drive pulse).

Figure 11A:
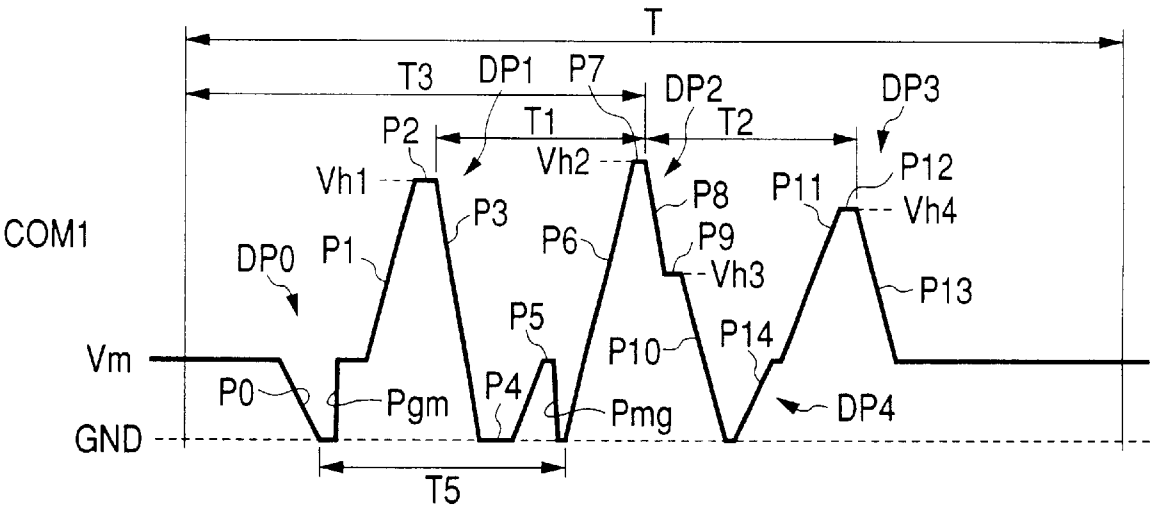
FIGS. 11A and 11B are diagrams for respectively explaining another drive signal for forward scanning and another drive signal for reverse scanning.
Figure 11B:
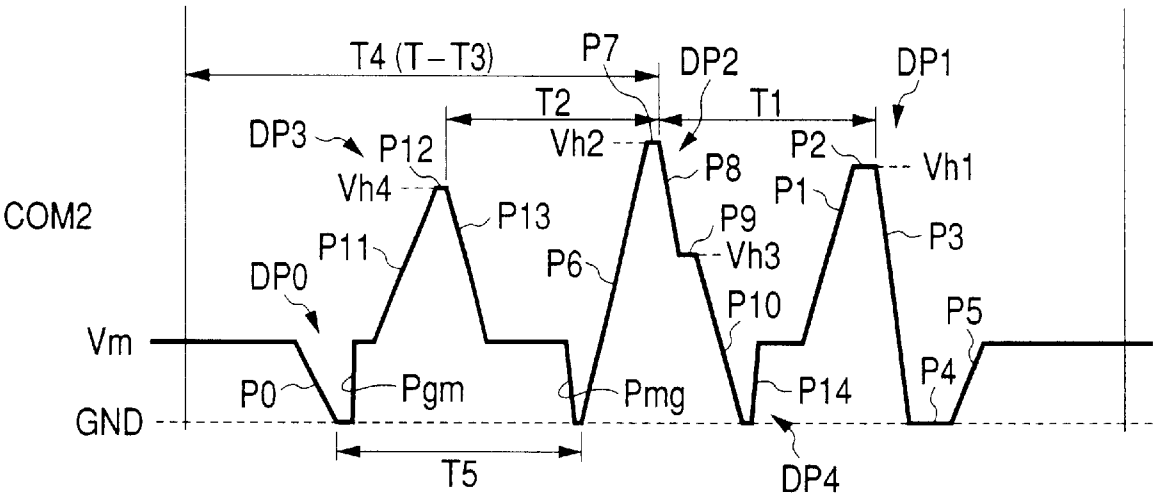

The recovery signal DP4 need not be located at the end of the drive signal, so long as it follows (is generated after) the microdot drive pulse DP2. For example, as is shown in FIG. 11, the recovery signal DP4 may be inserted instead of a first connection element Pgm, which will be described later.

When the drive signal COM, which comprises a series of drive pulses DP1, DP2 and DP3, the ready signal DP0 and the recovery signal DP4 are generated, a period occurs during which the voltage level is discontinued between adjacent signals.

Therefore, during the period wherein the voltage level is discontinuous, the drive signal generator 51 generates the first connection element Pgm, for raising the voltage level within an extremely short time period, or a second connection element Pmg, for dropping the voltage level within an extremely short time period. In this manner, the drive signal generator 51 can shift the voltage level to match a specific voltage.

Since, for example, the end voltage of the ready signal DP0 is the ground voltage GND and the start voltage of the large dot drive pulse DP1, which is generated after the ready signal DP0, is the middle voltage Vm, the drive signal generator 51 generates the first connection element Pgm between the ready signal DP0 and the large dot drive pulse DPi, and raises the voltage, within an extremely short time period, from the ground voltage GND to the middle voltage Vm.

Similarly, since the end voltage of the large dot drive pulse DP1 is the middle voltage Vm and the start voltage of the microdot drive pulse DP2, which is generated after the large dot drive pulse DP1, is the ground voltage GND, the drive signal generator 51 generates the second connection element Pmg between the large dot drive pulse DP1 and the microdot drive pulse DP2, and drops the voltage, within an extremely short time period, from the middle voltage Vm to the ground voltage GND.

The first and second connection elements Pgm and Pmg are waveform elements that are not actually selected, and that are not applied as drive waveforms to the piezoelectric vibrators 40. Therefore, even when a very drastic voltage change occurs, the piezoelectric vibrators 40 will not be damaged, and the piezoelectric vibrators 40 and the elastic film 36 that are bonded to the island portion 37 will not be peeled off.

The above described drive signal COM1 or COM2 is formed by the coexistence of the large dot drive pulse DP1 and the middle dot drive pulse DP3, whose bias levels are adjusted so they are equal to the bias level of the drive signal (middle voltage Vm corresponding to the reference bias level of the invention), and the microdot drive pulse DP2, whose bias level is adjusted to one (ground voltage GND corresponding to the individual bias level of the invention) that differs from that of the drive signal. The ready signal DPO precedes the microdot pulse DP2, and the recovery signal DP4 follows the microdot drive pulse DP2. In a period wherein the voltage levels of adjacent signals are discontinued, the first connection element Pgm or the second connection element Pmg is generated to match the voltage level.

When the microdot drive pulse DP2 is to be supplied to the piezoelectric vibrators 40, the drive pulse selector (the control unit 49, the shift register unit 54, the latch unit 55, the level shifter unit 56 and the switch unit 57) selects both the ready signal DP0 and the recovery signal DP4, as will be described later.

As a result, since the ready signal DP0 is supplied before the microdot drive pulse DP2, when the microdot drive pulse DP2 is to be supplied, the voltage of the piezoelectric vibrator 40 is dropped from the middle voltage Vm to the ground voltage GND. Further, since the recovery signal DP4 is supplied after the microdot drive pulse DP2, the voltage of the piezoelectric vibrator 40, which was dropped to the ground voltage GND due to the application of the microdot drive pulse DP2, is returned to the middle voltage Vm.

Therefore, even when a plurality of drive pulses having different bias levels are included in a drive signal, the maximum voltage of the drive signal can be suppressed, and the drive signal can fall within a limited voltage range. The devices that constitute the drive circuit can thus be prevented from being damaged, or an inexpensive, low voltage resistant device can be used to constitute the drive circuit.

Further, as in this embodiment, since the individual bias level is set to the ground voltage GND, the maximum voltage for the drive signal COM (Vh2 for the example drive signal) can be suppressed.

The recording operation performed by the printer 1 will now be explained.

In the recording operation, the type of ink droplet to be ejected is selected in accordance with image data. For example, a large dot (large ink droplet) is formed for a portion wherein the tone of an image is relatively heavy, a microdot (small ink droplet) is formed for a portion where the image tone is relatively light, and a middle dot (middle dot ink droplet) is formed for an intermediate portion.

Figure 10:
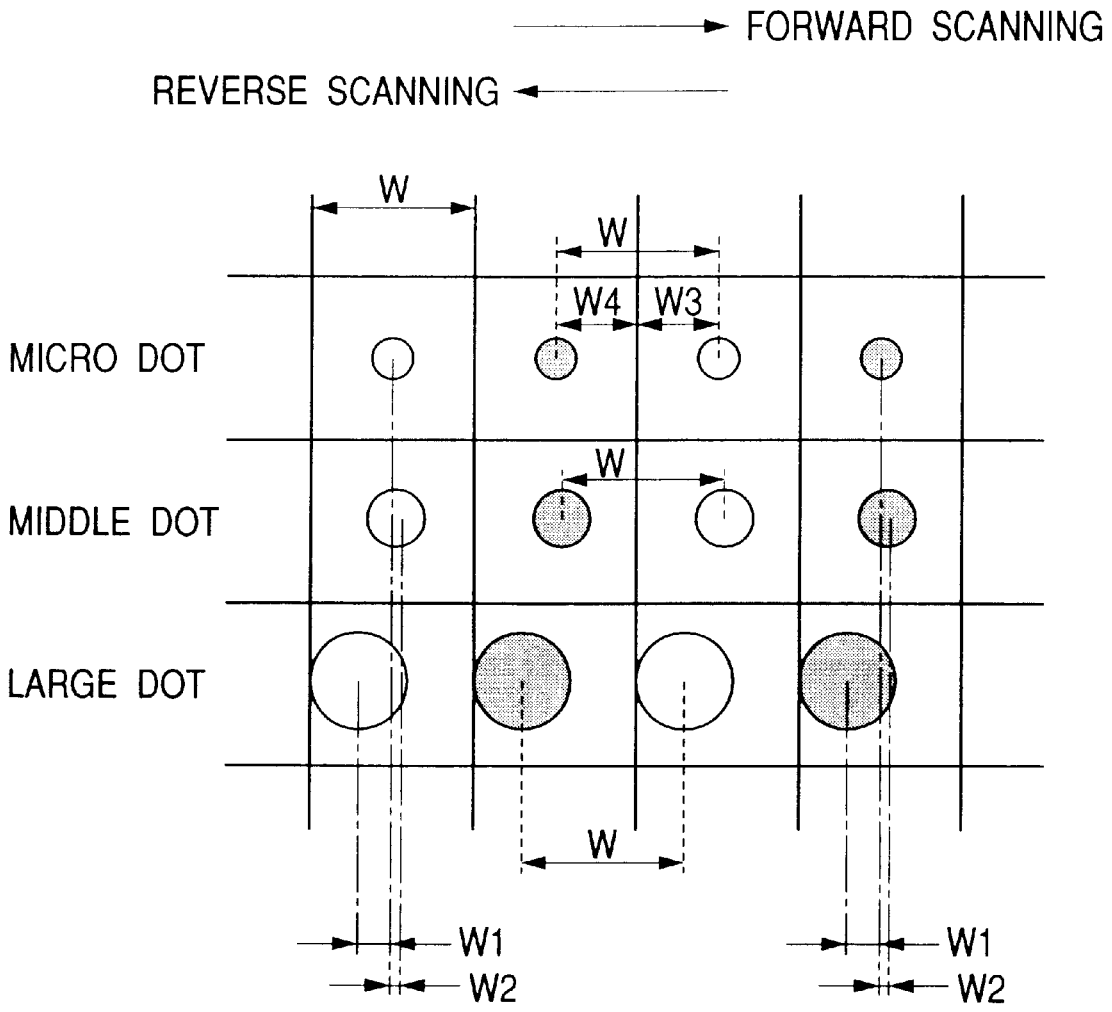
FIG. 10 is a diagram for explaining the positional relationship between dots recorded during forward scanning and dots recorded during reverse scanning.

Further, as part of the recording operation, during the reverse scanning a dot (pixel) is recorded between the dots (pixels) that are recorded during the forward scanning. For example, as is shown in FIG. 10, during the forward scanning performed with the recording head 3, the forward scanning dots, which are represented as white circles, are recorded, and during the reverse scanning, the reverse scanning dots, which are represented as shaded circles, are recorded between the adjacent forward scanning dots.

The print data (forward print data) that corresponds to signals constituting the forward drive signal COM1 are employed for the forward scanning of the recording head.

Figure 8:
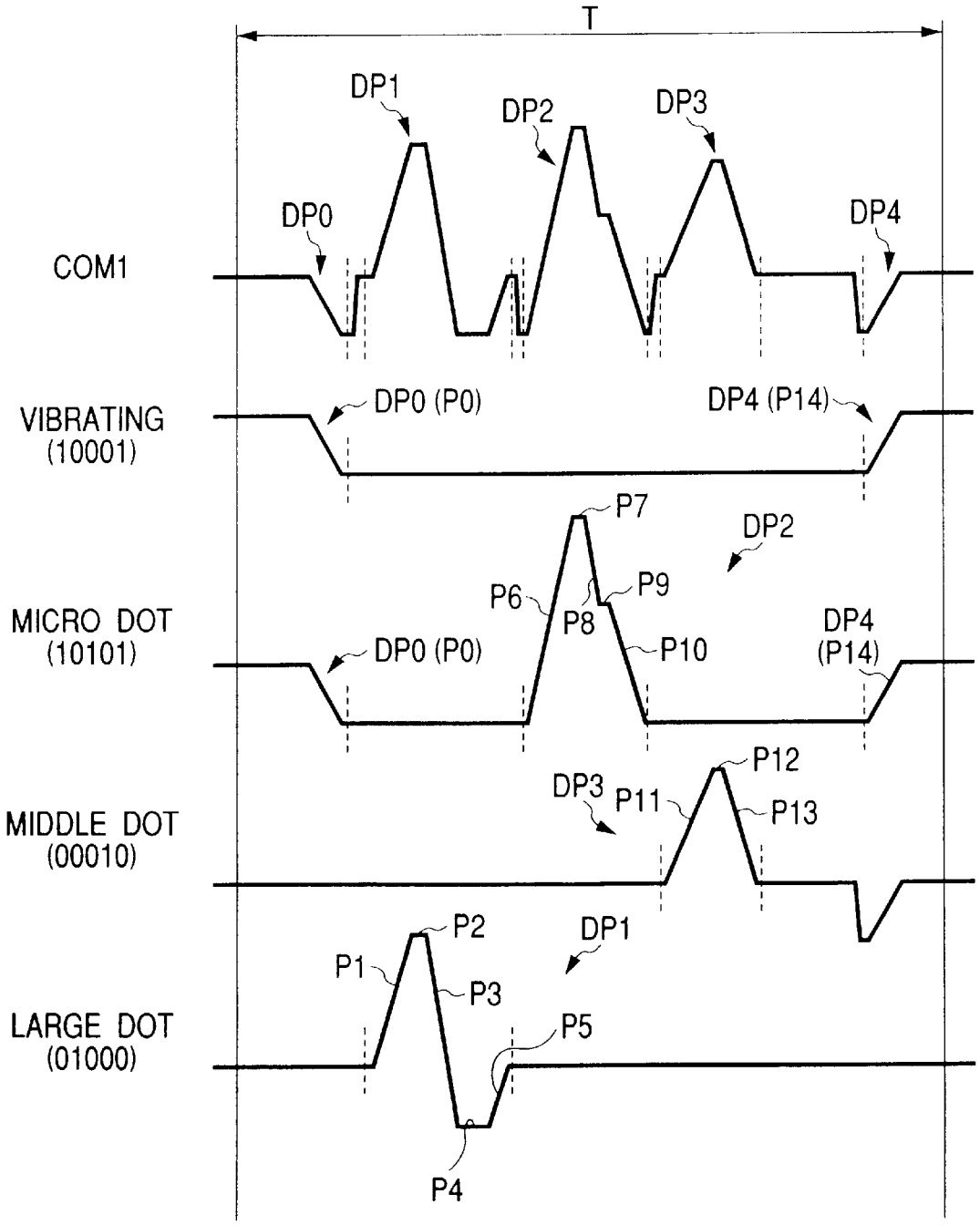
FIG. 8 is a diagram for explaining the relationship between the drive signal for forward scanning and a drive pulse supplied to the recording head.

As is shown in FIG. 8, each print data entry consists of the five bits D1, D1, D2, D3 and D4, which respectively correspond to the ready signal DP0, the large dot drive pulse DP1, the microdot drive pulse DP2, the middle dot drive pulse DP3 and the recovery signal DP4.

During the forward scanning performed with the recording head 3, the control unit 49 appropriately changes the bit settings for the print data D0, D1, D2, D3 and D4, and in that fashion selects the ink droplets that are to be ejected.

Specifically, to record a microdot on the recording sheet 11, the control unit 49 sets the print data D0=1, D1=1, D2=1, D3=0 and D4=1. To record a middle dot, the control unit 49 sets the print data D0=0, D1=0, D2=0, D3=1 and D4=0. To record a large dot, the control unit 49 sets the print data D0=0, D1=1, D2=0, D3=0 and D4=0. And to slightly vibrate a meniscus, the control unit 49 sets the print data D0=1, D1=0, D2=0, D3=0 and D4=1.

Print data (reverse print data) that corresponds to signals constituting the reverse drive signal COM2 are employed for the reverse scanning performed with the recording head.

Figure 9:
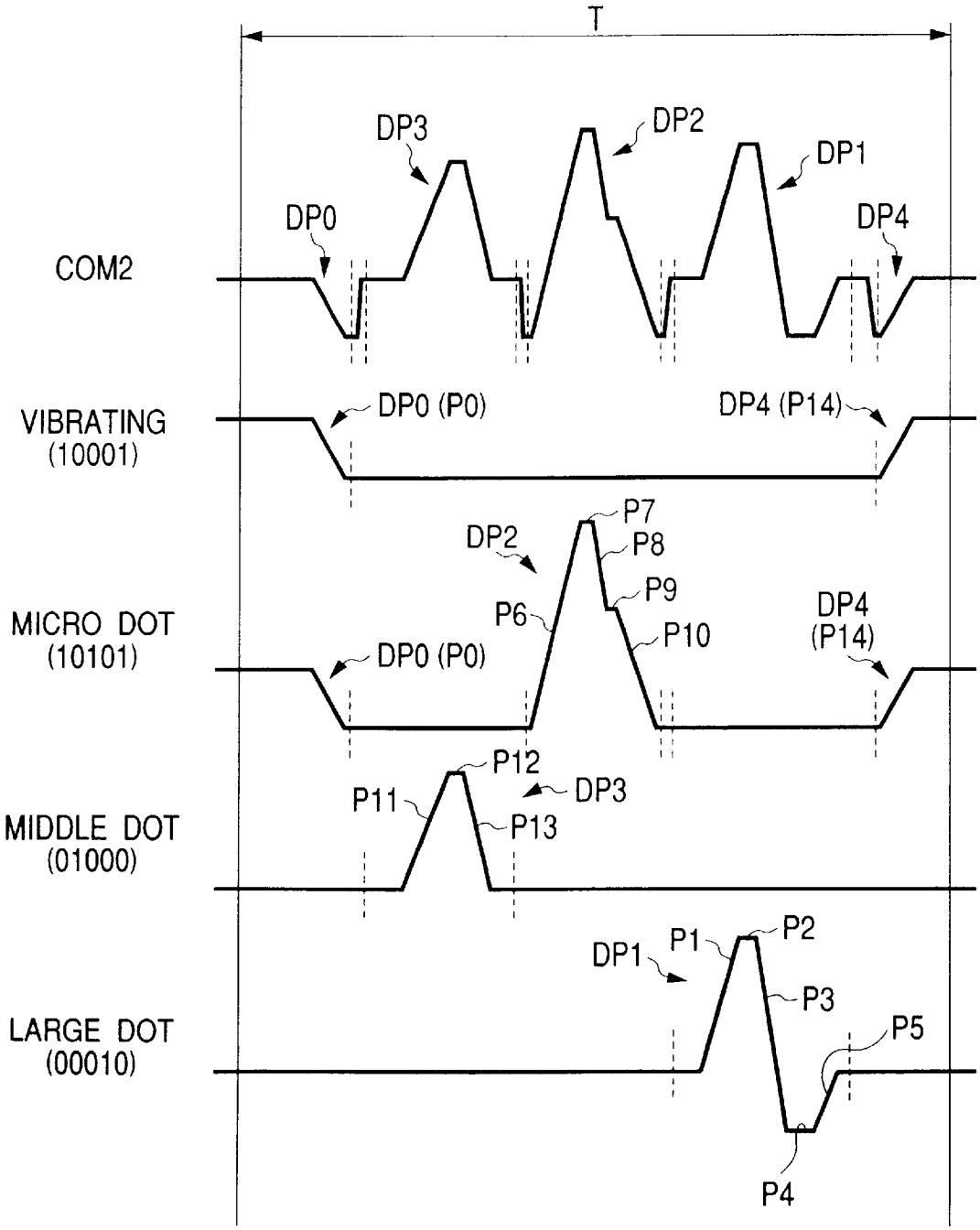
FIG. 9 is a diagram for explaining the relationship between the drive signal for reverse scanning and a drive pulse supplied to the recording head.

As is shown in FIG. 9, each print data entry consists of the five bits D0, D1, D2, D3 and D4, which respectively correspond to the ready signal DP0, the middle dot drive pulse DP3, the microdot drive pulse DP2, the large dot drive pulse DP1 and the recovery signal DP4.

During the reverse scanning performed with the recording head 3, the control unit 49 again appropriately changes the bit settings for the print data D0, D1, D2, D3 and D4, and in that fashion selects the ink droplet that is to be ejected.

Specifically, to record a microdot on the recording sheet 11, the control unit 49 sets the print data D0=1, D1=0, D2=1, D3=0 and D4=1. To record a middle dot, the control unit 49 sets the print data D0=0, D1=1, D2=0, D3=0 and D4=0. To record a large dot, the control unit 49 sets the print data D0=0, D1=0, D2=0, D3=1 and D4=0. And to slightly vibrate a meniscus, the control unit 49 sets the print data D0=1, D1=0, D2=0, D3=0 and D4=1.

Based on the print data for the microdot, the drive pulse selector (the control unit 49, the shift register unit 54, the latch unit 55, the level shifter unit 56 and the switch unit 57) selects the ready signal DP0, the microdot drive pulse DP2 and the recovery signal DP4. Thereafter, the selected signals DP0, DP2 and DP4 are sequentially transmitted to the piezoelectric vibrator 40.

In this case, first, using the first correction element P0, the volume of the pressure chamber 24 is gradually reduced from a reference volume that corresponds to the middle voltage Vm to the minimum volume that corresponds to the ground voltage GND. This minimum volume is maintained throughout the interval T5.

Following this, using the second expansion element P6, the pressure chamber 24 is expanded from the minimum volume to the second maximum volume, which corresponds to the maximum voltage Vh2. Since the pressure chamber 24 is expanded relatively quickly, a negative internal pressure is produced therein, and the meniscus is drawn inside the pressure chamber 24.

During the interval T5, extending from the time the first correction element P0 was supplied to the time the second expansion element P6 is supplied, a constant pressure chamber 24 volume is maintained in order to satisfactorily converge the vibration of the meniscus that accompanies the supply of the first correction element P0. That is, since an ink droplet containing an extremely small quantity of ink is to be ejected upon the receipt of the microdot drive pulse DP2, if the meniscus is vibrating rapidly when the microdot drive pulse DP2 is supplied, an ink droplet having a variable volume will be produced.

Thus, in order to maintain a constant volume for a small ink droplet, after the first correction element P0 is supplied a constant pressure chamber 24 volume is maintained during the interval T5, and after the vibration of the meniscus has appropriately converged, the second expansion element P6 is supplied.

In addition, in this embodiment, the interval from the time the first correction element P0 was supplied to the time at which the second expansion element P6 is supplied is set to the interval T5 for both the forward drive signal COM1 and the reverse drive signal COM2. Thus, the degree of vibration of the meniscus when the supply of the second expansion element P6 is started is the same for both the forward and the reverse scanning, and an ink droplet having the same volume can be produced for both the forward scanning and the reverse scanning.

When the second expansion element P6 is supplied, the second expansion holding element P7 is supplied during an extremely short time period. Then, using the second ejection element P8, the volume of the pressure chamber 24 is drastically reduced to the intermediate volume that corresponds to the discharge voltage Vh3, and the intermediate volume is maintained by the discharge holding element P9 for an extremely short time period. When at this time the second ejection element P8 and the discharge holding element P9 are supplied, a small ink droplet is ejected through the nozzle orifice 25.

Thereafter, using the discharge element P10, the volume of the pressure chamber 24 is reduced from the intermediate volume to the minimum volume at a speed that will not cause an ink droplet to be ejected, and the minimum volume is maintained. Then, using the second correction element 14, the pressure chamber 24 is expanded and restored to the reference volume.

Based on the print data for the middle dot, the drive pulse selector selects the middle dot drive pulse DP3, which is then supplied to the piezoelectric vibrator 40.

When the middle dot drive pulse DP3 is supplied, first, using the third expansion element P11 the pressure chamber 24 is expanded from the reference volume that corresponds to the middle voltage Vm to the third maximum volume that corresponds to the third maximum voltage Vh4. Then, using the third expansion holding element P12, the expanded state of the pressure chamber 24 is maintained for an extremely short time period, and using the third ejection element P13, the volume of the pressure chamber 24 is drastically reduced from the third maximum volume to the reference volume. In accordance with the drastic volume reduction of the pressure chamber 24, the ink pressure inside the pressure chamber 24 is increased, and a middle ink droplet is ejected through the nozzle orifice 25.

Based on the print data for a large dot, the drive pulse selector selects the large dot drive pulse DP1, which is then supplied to the piezoelectric vibrator 40.

When the large dot drive pulse DP1 is supplied, first, using the first expansion element P1 the pressure chamber 24 is expanded from the reference volume that corresponds to the middle voltage Vm to the first maximum volume that corresponds to the first maximum voltage Vh1.

After the expanded state of the pressure chamber 24 has been maintained by the first expansion holding element P2 for a predetermined time period, using the first ejection element P3 the volume of the pressure chamber 24 is reduced to the minimum volume, which corresponds to the ground voltage GND, and the minimum volume is maintained by the retraction hold element P4 for a predetermined time period. In accordance with this drastic reduction in size of the pressure chamber 24, the pressure inside the pressure chamber 24 is increased, and a large ink droplet is ejected through the nozzle orifice 25.

When a large ink droplet has been ejected, using the vibration control element P5 the pressure chamber 24 is expanded, and from the minimum volume, is restored to the reference volume. In accordance with the expansion of the pressure chamber 24, the vibration of the meniscus is converged within a relatively short time period.

Based on the print data for a slight vibration, the drive pulse selector selects the ready signal.DP0 and the recovery signal DP4, which are thereafter sequentially transmitted to the piezoelectric vibrator 40. That is, the ready signal DP0 (the first correction element P0, which is a ready waveform) and the recovery signal DP4 (the second correction element P14, which is a recovery waveform) are employed as a vibrating waveform.

When the vibrating waveform is supplied, first, using the first correction element P0 the volume of the pressure chamber 24 is reduced relatively slowly from the reference volume, which is the middle voltage Vm, to the minimum volume, which corresponds to the ground voltage GND. In accordance with this volume reduction, the pressure chamber 24 is slightly pressurized, and the meniscus is shifted slightly in the ink ejection direction. The reduced volume state of the pressure chamber 24 is maintained until the second correction element P14 is supplied, and during this period, residual vibration vibrates the meniscus slightly. Then, using the second correction element P14, the pressure chamber 24 is expanded and is relatively slowly returned to the reference volume.

In this embodiment, as is described above, the forward drive signal COM1, in which the drive pulses DP1, DP2 and DP3 are arranged in the predetermined order, is generated during the forward scanning performed with the recording head 3, while the reverse drive signal COM2, in which the drive pulses DP1, DP2 and DP3 are arranged in the inverted order, is generated during the reverse scanning performed with the recording head 3, and both the forward drive signal COM1 and the reverse drive signal COM2 are employed for bidirectional recording.

As a result, as is shown in FIG. 10, uniform intervals can be obtained between adjacent dots. This is because the order in which the ink droplets are ejected during the forward scanning is the opposite of the order in which the ink droplets are ejected during the reverse scanning.

Specifically, since the scanning direction of the recording head 3 during forward scanning is the opposite of that during reverse scanning, during forward scanning an ink droplet that is ejected at an early stage in the print cycle T lands in the near end of a pixel area in the main scanning direction, and during reverse scanning, such an ink droplet lands in the far end of a pixel area in the main scanning direction. Similarly, during forward scanning an ink droplet that is ejected at a later stage in the print cycle T lands at the far end of a pixel area in the main scanning direction, and during reverse scanning, such an ink droplet lands in the near end of a pixel area in the main scanning direction.

When the order of the drive pulses in the arrangement for the reverse drive signal COM2 is the inverted order of the drive pulses in the arrangement for the forward drive signal COM1, the drive pulse that is located at the head of the forward drive signal COM1 is located at the end of the reverse drive signal COM2. In other words, an ink droplet that would be ejected first during the forward scanning performed with the recording head 3 would be ejected last during the reverse scanning performed by the recording head 3.

Therefore, the position whereat an ink droplet will land in a pixel area in the main scanning direction can be aligned with an ink droplet that is ejected during the forward scanning and with an ink droplet that is ejected during the reverse scanning, and a uniform interval between adjacent dots can be obtained.

Furthermore, in this embodiment, for the forward drive signal COM1 used during the forward scanning and for the reverse drive signal COM2 used during the reverse scanning, the same time is set for the interval between the ejection elements of the adjacent drive pulses in the forward drive signal COM1 and for the interval between the ejection elements of the adjacent drive pulses in the reverse drive signal COM2.

For example, the second ejection element P8 of the microdot drive pulse DP2 and the first ejection element P3 of the large dot drive pulse DP1 are aligned with the same intervening interval T1, both for the forward drive signal COM1 and the reverse drive signal COM2. Similarly, the second ejection element P8 of the microdot drive pulse DP2 and the third ejection element P13 of the middle dot drive pulse DP3 are aligned with the same intervening interval T2, both for the forward drive signal COM1 and the reverse drive signal COM2.

As is described above, since for the forward drive signal COM1 and the reverse drive signal COM2 the intervals, T1 and T2, between the ejection elements of the adjacent drive pulses are aligned, for forward scanning and for reverse scanning, corresponding distances between positions whereat ink droplets of different types (volumes) will land can be set. For example, a distance W1, extending from the center of a location whereat a small ink droplet has landed to the center of a location whereat a large ink droplet has landed, and a distance W2 extending from the center of a location whereat the small ink droplet has landed to the center of a location whereat a middle ink droplet has landed, can be so that they correspond, both for forward scanning and for reverse scanning.

Therefore, by adjusting the location whereat an ink droplet, i.e., the small ink droplet in this embodiment, that is used as a positioning reference lands, a constant interval can be provided that is used for aligning the locations of all ink droplets.

Concerning this aspect, as is described above in this embodiment, the sum of the interval T3 (45.5 $\mu$s), which continues until the second ejection element P8 of the forward drive signal COM1 is reached, and the interval T4 (47.1 $\mu$s), which continues until the second ejection element P8 of the reverse drive signal COM2 is reached, is set equal to the print cycle T (92.6 $\mu$s).

Therefore, when the width of the pixel area is defined as W, during forward scanning performed with the recording head 3, a microdot will land at a location W3 at a distance W×(45.5/92.6) from the near end of a pixel area in the main scanning direction. And during reverse scanning performed with the recording head 3, a microdot will land at a location W4 at a distance W×(47.1/92.6) from the other, far end of the pixel area in the main scanning direction.

The interval between a microdot recorded during forward scanning and one recorded during reverse scanning is W3+W4, i.e., W. Therefore, since the interval between a microdot recorded during forward scanning and a microdot recorded during reverse scanning is the constant, W, the formation of a coarse image can be precisely prevented, and the image quality can be enhanced.

In this embodiment, a drive signal has been employed in which three drive pulses, for enabling the ejection of ink droplets, are arranged within one print cycle T. However, the number of drive pulses is not limited to three. A drive signal may include four drive pulses that are arranged within one print cycle T, or even five.

The drive signal generator 51 in this embodiment is designed so that, for every predetermined update cycle that is defined by the second timing signal, the voltage change data stored in the first waveform latch unit 64 are added to the output voltage of the second waveform latch unit 65 to generate an arbitrary waveform. However, the drive signal generator 51 is not limited to this configuration.

As another example configuration for the drive signal generator 51, an analog circuit is employed to constitute a first drive signal generator for generating the forward drive signal COM1 and to constitute a second drive signal generator for generating the reverse drive signal COM2, and these generators are provided for the printer controller 44. During forward scanning, the first drive signal generator supplies the forward drive signal COM1 to the recording head 3, while during reverse scanning, the second drive signal generator supplies the reverse drive signal to the recording head 3.

Furthermore, the pressure generating element for varying the pressure in the pressure chamber 24 is not limited to the piezoelectric vibrator 40. A magnetic distortion device, for example, may be employed as a pressure generating element, as can a heat generating device that uses heat to expand or shrink an air bubble and thereby induces pressure changes in the pressure chamber 24.

What is claimed is:

1. An ink jet recording apparatus comprising:

a recording head reciprocately moving in a main scanning direction with regard to a recording medium, the recording head provided with:

a nozzle orifice from which an ink drop is ejected;

a pressure chamber communicated with the nozzle orifice; and a pressure generating element for generating pressure change in ink in the pressure chamber;

a drive signal generator for generating a drive signal in which a plurality of drive pulses configured to drive the pressure generating element to eject an ink drop from the nozzle orifice, respectively, the drive signal including:

a first drive pulse configured to drive the pressure generating element to eject an ink drop from the nozzle orifice, and to have a reference bias level;

a second drive pulse configured to drive the pressure generating element to eject an ink drop from the nozzle orifice, and to have an individual bias level which is different from the reference bias level;

a ready waveform for varying a potential of the drive signal from the reference bias level to the individual bias level, which is arranged in the drive signal so as to precede to the second drive pulse; and a recovery waveform for varying the potential of the drive signal from the individual bias level to the reference bias level, which is arranged in the drive signal so as to follow the second drive signal; and a drive pulse selector for selectively supplying at least one of the drive pulses and the waveforms in the drive signal to the pressure generating element to eject an ink drop from the nozzle orifice, wherein the drive pulse selector selects the second drive pulse together with the ready waveform and the recovery waveform.

2. The ink jet recording apparatus as set forth in claim 1, wherein the drive signal includes:

a forward drive signal in which the plural drive pulses are arranged in a predetermined order, which is generated during a forward scanning of the reciprocate movement performed with the recording head; and a reverse drive signal in which the plural drive pulses are arranged in an order resulted by inverting the predetermined order, which is generated during a reverse scanning of the reciprocate movement performed with the recording head, wherein a period extending from a trailing end of the ready waveform to a leading end of the second drive pulse in the forward drive signal is coincided with a period extending from a trailing end of the ready waveform to a leading end of the second drive pulse in the reverse drive signal.

3. The ink jet recording apparatus as set forth in claim 1, wherein the ready waveform is arranged in a head portion of the drive signal.

4. The ink jet recording apparatus as set forth in claim 1, wherein a period extending from a leading end of the ready waveform to a trailing end thereof is equal or greater than a Helmholtz resonance cycle of the pressure chamber.

5. The ink jet recording apparatus as set forth in claim 1, wherein a period extending from a leading end of the recovery waveform to a trailing end thereof is equal or greater than a Helmholtz resonance cycle of the pressure chamber.

6. The ink jet recording apparatus as set forth in claim 1, wherein the ready waveform and the recovery waveform have a voltage gradient which is insufficient to eject an ink drop from the nozzle orifice, respectively.

7. The ink jet recording apparatus as set forth in claim 1, wherein the individual bias level is set to a ground voltage.

8. The ink jet recording apparatus as set forth in claim 1, wherein the second drive pulse serves as a reference drive pulse having an ejection waveform element for ejecting an ink drop which provides a positional reference in a pixel region;

wherein the drive signal includes:

a forward drive signal in which the plural drive pulses are arranged in a predetermined order, which is generated during a forward scanning of the reciprocate movement performed with the recording head; and a reverse drive signal in which the plural drive pulses are arranged in an order resulted by inverting the predetermined order, which is generated during a reverse scanning of the reciprocate movement performed with the recording head;

wherein a period extending from a leading end of the forward drive signal to a trailing end thereof and a period extending from a leading end of the reverse drive signal to a trailing end thereof are correspond to an unit print cycle; and wherein the unit print cycle is coincided with a sum of a period extending from the leading end of the forward drive signal to a leading end of the ejection waveform element in the forward drive signal and a period extending from the leading end of the reverse drive signal to a leading end of the ejection waveform element in the reverse drive signal.

9. The ink jet recording apparatus as set forth in claim 1, wherein the drive signal includes:

a forward drive signal in which the plural drive pulses are arranged in a predetermined order, which is generated during a forward scanning of the reciprocate movement performed with the recording head; and a reverse drive signal in which the plural drive pulses are arranged in an order resulted by inverting the predetermined order, which is generated during a reverse scanning of the reciprocate movement performed with the recording head; and wherein an interval between adjacent drive pulses in the forward drive signal is coincided with an interval between adjacent drive pulses in the reverse drive signal.

10. The ink jet recording apparatus as set forth in claim 1, wherein the pulse selector selectively supplies the ready waveform and the recovery waveform to form a vibrating waveform for vibrating a meniscus of ink in the nozzle orifice.

* * * * *